United States Patent [19]

Gustafsson et al.

[11] 4,081,984

[45] Apr. 4, 1978

[54] PROTECTIVE COATING FOR REMOVABLE LINER OF PRESS FOR HYDROSTATIC EXTRUSION

[75] Inventors: Sven-Göran Gustafsson, Vesteras; Jan Nilsson, Robertsfors; Pertti Syväkari, Helsingborg, all of Sweden

[73] Assignee: ASEA Aktiebolag, Vesteras, Sweden

[21] Appl. No.: 788,665

[22] Filed: Apr. 18, 1977

[30] Foreign Application Priority Data

Apr. 22, 1976 Sweden ..... 7604613

[51] Int. Cl.[2] ..... B21D 22/10

[52] U.S. Cl. ..... 72/60; 72/272; 92/169

[58] Field of Search ..... 72/60, 253, 272, DIG. 31; 92/169

[56] References Cited

U.S. PATENT DOCUMENTS

| | | | |
|---|---|---|---|
| 3,364,717 | 1/1968 | Green | 72/272 X |
| 3,751,958 | 8/1973 | Nilsson et al. | 72/60 |
| 3,914,968 | 10/1975 | Korsell | 72/60 |
| 4,016,737 | 4/1977 | Gustafsson et al. | 72/60 |

*Primary Examiner*—Leon Gilden

*Attorney, Agent, or Firm*—Watson, Cole, Grindle & Watson

[57] ABSTRACT

A press for the hydrostatic extrusion of metallic billets to form tubes and other profiles includes a hollow high pressure cylinder having a removable liner which forms the inner wall thereof and which encloses the internal pressure chamber. To protect the removable liner from fatigue breakdown, the inner wall of the liner is coated with a protective coating of an organic polymer and a metallic tube is located adjacent the protective coating and concentric therewith, between the protective coating and the internal pressure chamber.

11 Claims, 2 Drawing Figures

PROTECTIVE COATING FOR REMOVABLE LINER OF PRESS FOR HYDROSTATIC EXTRUSION

BACKGROUND OF THE INVENTION

During the hydrostatic extrusion of a billet of metallic material, the billet is surrounded by a pressure medium which exerts thereon the pressure necessary for the material of the billet to be pressed out through a passage in the die of the press in order to form a tube or rod-like product. The presses which are usually used in this connection include a pressure chamber for the pressure medium, such pressure chambers conventionally being formed within a hollow, open ended high pressure cylinder, a die arranged in one end opening of the high pressure cylinder for forming the material of the billet therethrough, and a punch insertable into the other end opening of the high pressure cylinder for generating the required pressure on the pressure medium in the pressure chamber. Internally, the high pressure cylinders are exposed to very great and extremely varying stresses, which leads to a fatigue of their portions located nearest to the pressure chamber formed therewithin. The high pressure cylinder is therefore normally constructed with an internal part, i.e., a liner which is, in the form of a tube that is exchangeable, and which can therefore be replaced by a new liner when it has been consumed by fatigue breakdown or when fatigue breakdown may be expected. In order for the liner to be as resistant as possible to the stresses, it is usually made of a high-tensile steel and is usually prestressed strongly against the surrounding parts of the rest of the high pressure cylinder.

It is an object of the present invention to considerably increase the fatigue strength of such cylinder liners, thus considerably extending their useful life. It is a further object of the present invention to provide improved liners which are useful in presses which extrude preheated billets with vegetable oils as the pressure medium.

SUMMARY OF THE INVENTION

According to the invention, the improved results are obtained by coating at least those parts of the surface of the liner which face the pressure chamber and which are particularly exposed to fatigue breakdown with a coating of an organic polymer, and by employing a mechanical protection means for the coating which is concentric with the coating.

More particularly, the invention relates to a press for hydrostatic extrusion of tubes and profiles of metallic material, comprising an elongated, hollow, high pressure cylinder which has openings at the elongated ends thereof and which encloses a pressure chamber, a die closing one opening of the cylinder which includes a passageway for extending a metal therethrough to form other tube or a profile, and a punch insertable into the other opening of the cylinder for generating a pressure necessary for extrusion of a billet of the metallic material by means of a pressure medium enclosed in the pressure chamber and surrounding the billet, the high pressure cylinder comprising an internally arranged, exchangeable (replaceable) liner, characterised in that at least part of the surface of the liner, facing the pressure chamber, is provided with a coating of an organic polymer and that a mechanical protection means for the coating, which means is concentric with the coating, and which is preferably in the form of a tube or several consecutively arranged tubular or annular bodies, is arranged inside the surface of the coating facing the pressure chamber.

A feasible explanation of the favorable effect obtained according to the present invention is that the coating of polymer and the concentric protection cooperate in efficiently protecting the liner against corrosion attack from the pressure medium and from decomposition products of the pressure medium formed during the extrusion process. In this way a deterioration of the surface of the liner, which would otherwise occur, can be reduced, and thus the resultant fatigue can also be reduced. A coating of polymer may be applied with excellent adhesion to the surface of the lining, and because of its ductility, it is able to follow the relatively great extension of the liner which occurs when the press is used.

The present invention is particularly adapted to be used for extrusion of billets of copper and copper alloys, especially if they have been preheated to at least 200° C. By copper alloys are meant here alloys which up to at least 55 percent by weight consist of copper. As examples of such alloys may be mentioned an alloy containing 63 percent by weight Cu and 37 percent by weight Zn; an alloy containing 71 percent by weight Cu, 28 percent by weight Zn and 1 percent by weight Sn; and an alloy containing 77 percent by weight Cu, 21 percent by weight Zn and 2 percent by weight Al.

The invention offers advantages also when extruding billets of other metallic materials such as, e.g., aluminium and aluminium alloys, especially if they are preheated to at least 200° C. By aluminium alloys are meant alloys which for at least 85 percent by weight consist of aluminium. As examples of such alloys may be mentioned an alloy containing 5.5 percent by weight Cu, 0.5 percent by weight Pb, 0.5 percent by weight B, the remainder being Al (AA 2011); an alloy containing 4.5 percent by weight Cu, 1.5 percent by weight Mg, 0.6 percent by weight Mn, the remainder being Al (AA 2024); and an alloy containing 5.5. percent by weight Zn, 2.5 percent by weight Mg, 1.5 percent by weight Cu, 0.3 percent by weight Cr, the remainder being Al (AA 7075).

Examples of suitable pressure media for the press according to the present invention are vegetable oils such as castor oil, palm oil and colza oil.

The organic polymer in the coating may consist of a thermosetting resin such as, e.g., polyimide, polyester imide, polyethylene glycol terephthalate, polyurethane, silicon and epoxy resin; a thermoplast such as, e.g., polysulphon, polyphenylene sulphide and polytetrafluoro ethylene, or of an elastomer such as, e.g., polyurethane and silicon. Examples of usable particular polymers are polyimides under the Trade Mark Pyre—ML Wire Enamel from Du Pont de Neumours, USA, polysulphons under the Trade Mark Udel Polysulfone from Union Carbide Corp., USA, and polyphenylene sulphide under the Trade Mark Intercoat PPS/1 from Farg AB International, Sweden.

For manufacturing tubes it has proved to be particularly important to coat with the organic polymer at least that part of the surface of the liner which corresponds to the zone of the pressure to which the punch is insertable, and to utilize the concentric protection means therefor accordingly.

The concentric protection means may either make contact with the coating or be arranged so that a gap, accessible to the pressure medium, occurs between the coating and the protection means.

DESCRIPTION OF THE DRAWINGS

The invention will be explained in more detail by way of examples with reference to the accompanying drawings, in which.

DESCRIPTION OF THE PREFERRED EMBODIMENT

Figure 1:
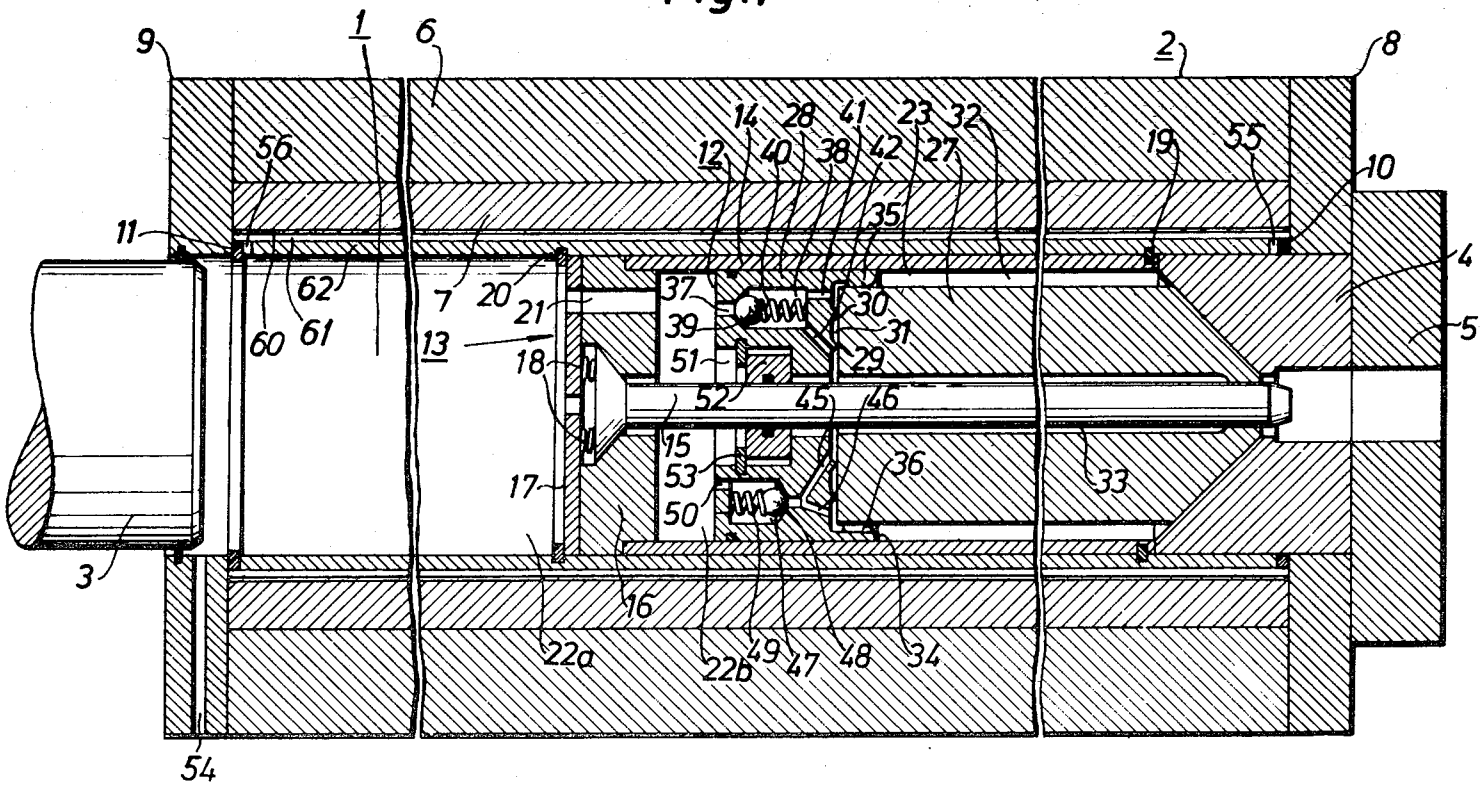
FIG. 1 shows a sectional view of a press according to the invention for manufacturing tubes and FIG. 2 shows a sectional view of a modified embodiment of the press according to FIG. 1.

In FIG. 1, 1 designates a pressure chamber formed between a high pressure cylinder 2, a pressure-generating punch 3 and a die 4. Die 4 rests against a die support 5. The cylinder 2 composed of a steel tube 6 which is surrounded by a prestressed strip sheath, and of a lining in the form of a tube 7 of high-tensile steel such as SIS 2242 (C=0.35-0.42%, Si=0.8-1.2%, Mn=0.3-0.6%, Cr=5.0-5.5%, Mo=1.2-1.6%, V=0.85-1.15%, P max.=0.03%, S max.=0.02%). The tube 7 is radially prestressed having been conically pressed into tube 6, and is replayable. The cylinder 2 is provided with end pieces 8 and 9, and these end pieces act as supports for seals 10 and 11 for sealing the pessure chamber against the end pieces and against the die and the punch. Along the entire surface of the liner tube 7 facing the pressure chamber is provided with a coating 60 of an organic polymer consisting of a layer of a polyimide (Pure - ML Wire Enamel RC-5044 from Du Pont de Neumours USA) which is about 25 microns thick. Between the coating 60 and the pressure chamber, and concentric therewith, a protective tube 62 of carbon steel or stainless steel is arranged, but so as to leave an intermediate gap 61. Parts 60-62 are the object of the present invention. Inside the high pressure cylinder is a unit 13 consisting of a spacing tube 14, a mandrel 15, a plate 16 transmitting forces from the mandrel to the spacing tube, a lid 17 and springs 18 fixing the mandrel to the plate 16 and a billet holder 12 which is axially movable inside tube 14 and along mandrel 15. The billet holder 12 centers the mandrel 15. During pressing, the mandrel force is transmitted by way of plate 16 and tube 14 to die 4. During the remaining periods of a work cycle, unit 13 is axially fixed by the locking rings 19 and 20 in the protective tube 62. There is, however, a certain axial clearance. A channel 21 is provided through lid 17 and plate 16.

The billet holder 12 divides the pressure chamber 1 into two spaces 22 and 23. Space 22 between the pressure generating punch 3 and the billet holder 12 is divided into two parts 22*a* and 22*b* by the plate 16. In space 23 between billet holder 12 and die 4 is the billet 27 to be extruded and which is provided with a central hole through which mandrel 15 extends. The billet holder includes a portion 28 with two annular projections 29 and 30 sealingly abutting the end surface of the billet 27 and defining a space 31 from gaps 32 and 33 between billet 27 and tube 14 and mandrel 15, respectively. The billet holder is thus provided with conventional members for connecting it to the billet. The billet holder is also provided with a guide means 34 with projections 35 for centering the billet 27 and with grooves 36. In the billet holder 12 there is a forward flow path for pressure medium which consists of channel 37, valve housing 38 with a valve member 39 and a valve spring 40, and channels 41 and 42, and which permits pressure medium to flow from space 22*b*to gaps 32 and 33 at a pressure difference between the two sides of the billet holder determined by the valve member 39. There is also a return flow path comprising channels 45 and 46, valve housing 47 with valve member 48 and spring 49, and channel 50, which permits pressure medium to flow in the opposite direction when the volumes of the gaps are reduced during the extrusion. In the billet holder portion 28 there is a recess 51 in which there is arranged a bushing 52 which is axially fixed by a locking ring 53. Between the recess and the bushing there is a clearance so that the bushing 52 is able to move radially in relation to the billet holder portion 28. 54 designates a channel for the supply of pressure medium, in the exemplified case consisting of castor oil, to the pressure chamber.

When billet 27 is placed in the high pressure cylinder 2, the high pressure cylinder is displaced from the stationary die support 5, i.e. to the left in FIG. 1, to a sufficient extent to place the billet in position. In the exemplified case the billet consists of copper or copper alloy having a temperature of about 550° C. Also the die 4, suitably also heated, is mounted in position on the billet before the high pressure cylinder and the punch are displaced in a direction towards the die support to the position shown FIG. 1. Pressure medium is then supplied through channel 54 to space 22. The pressure in the pressure medium is sufficiently high for the pressure medium to be forwarded to different parts of the space 23. The pressure medium also enters into gap 61 by way of radial slots 55 and 56 in the protective tube 62. The pressing out of a tube of the billet through the die 4 is achieved by displacing the punch 3 in a direction towards the die. When such a displacement is performed, channel 54 is closed to the flow of pressure medium.

Figure 2:
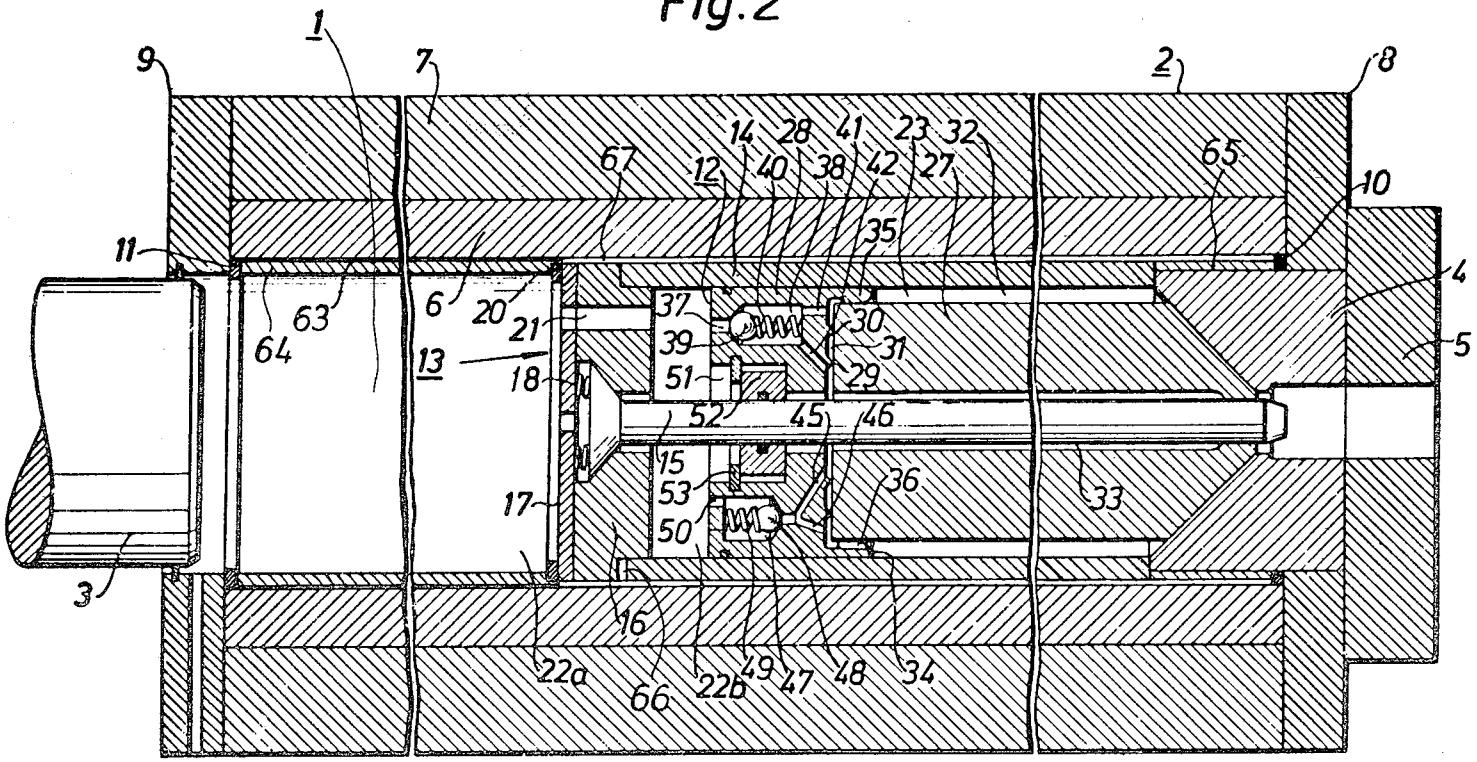

In the modified embodiment of the press according to FIG. 1, i.e. as shown in FIG. 2, the designations from FIG. 1 have been retained for the parts which are also included in FIG. 2. In accordance with FIG. 2, the coating 63 of the polymer is applied only on that part of the surface of the liner tube 6 which is located in the area of the pressure chamber 1 where the punch is insertable, that is, around space 22*a*. It is in this very part of the liner tube that damage has proved to occur. A protective tube 64 concentric with the coating is applied in direct contact with the coating. It is, however, possible to arrange a gap between the coating and the protective tube, in the same way as it is possible in the press according to FIG. 1 to arrange the protective tube in immediate contact with the coating. Plate 16, spacing tube 14 and ring 65 outside die 4 may in this case make contact directly with liner tube 6 or rather be arranged with an intermediate gap 67 to the liner tube, accessible to the pressure medium, for example, through slot 66 in tube 14. If, in the device according to FIG. 2, the coating is allowed to extend along the entire inwardly-turned surface of the liner tube, parts 16, 14 and 65 may be said to serve as protective tubes for the polymer layer.

The measures taken against fatigue of the liner, shown in FIGS. 1 and 2, may, of course, be employed also in presses for pressing rods. The presses used in that case are considerably simpler since they do not include any mandrel or any of the other parts of unit 13.

We claim:

1. A press for the hydrostatic extrusion of metallic billets which includes:

an elongated high pressure cylinder which has a hollow interior and which has openings at the ends thereof, the hollow interior forming a pressure chamber;

a die positioned to close to one of said openings in said high pressure cylinder, said die including a passageway therein through which metal may be extruded in order to form a tube or other profile;

a punch which is insertable through the other of said openings in said high pressure cylinder and which can project into said pressure cylinder to a predetermined point in order to generate a pressure in said pressure chamber for extrusion of a metallic billet through said passageway in said die;

a removably positioned liner forming an inner wall of said high pressure cylinder which encloses said pressure chamber, said liner having an inner wall facing said pressure chamber;

a protective coating of an organic polymer located along said inner wall of said liner which faces said pressure chamber; and means in the form of a tube positioned in concentric fashion adjacent said protective coating and between said protective coating and said pressure chamber for mechanical protection of said protective coating.

2. The press of claim 1 wherein said protective coating of an organic polymer is located along said inner wall of said liner from a point adjacent said other of said openings at least to a point adjacent said predetermined point at which said punch can project into said pressure chamber.

3. The press of claim 1 wherein said means in the form of a tube is positioned in contact with said protective coating of an organic polymer.

4. The press of claim 1 wherein said means in the form of a tube is positioned adjacent said protective coating of an organic polymer so as to leave a gap therebetween.

5. The press of claim 4 wherein said means in the form of a tube includes a passage means therethrough providing fluid communication between said pressure chamber and said gap.

6. The press of claim 1 wherein said organic polymer consists of a thermosetting resin.

7. The press of claim 1 wherein said thermosetting resin consists of polyimide.

8. The press of claim 1 wherein said organic polymer consists of a thermoplast.

9. The press of claim 1 wherein said polymer consists of an elastomer.

10. The press of claim 1 wherein said means in the form of a tube comprises a steel tube.

11. The press of claim 1 wherein said means in the form of a tube comprises several consecutively arranged annular bodies.

* * * * *